United States Patent [19]

Koch et al.

[11] Patent Number: 5,063,882

[45] Date of Patent: Nov. 12, 1991

[54] OIL SEPARATOR FOR GASES FROM A CRANKCASE OF AN INTERNAL-COMBUSTION ENGINE

[75] Inventors: Alfred Koch, Weissach; Dieter Stephan, Eberdingen, both of Fed. Rep. of Germany

[73] Assignee: Dr. Ing.h.c.F. Porsche Aktiengesellschaft, Fed. Rep. of Germany

[21] Appl. No.: 625,353

[22] Filed: Dec. 11, 1990

[30] Foreign Application Priority Data

Jan. 3, 1990 [DE] Fed. Rep. of Germany ..... 4000060

[51] Int. Cl.[5] ..... F01M 13/00

[52] U.S. Cl. ..... 123/41.86; 123/572

[58] Field of Search ..... 123/41.86, 572, 574

[56] References Cited

U.S. PATENT DOCUMENTS 2,849,994 9/1958 Barker ..... 123/41.86
4,565,164 1/1986 Satoh et al. ..... 123/41.86
4,723,529 2/1988 Yokoi et al. ..... 123/41.86

FOREIGN PATENT DOCUMENTS

3625836A1 2/1988 Fed. Rep. of Germany .
3713210 11/1988 Fed. Rep. of Germany .

OTHER PUBLICATIONS

Patent Abstracts of Japan, vol. 9, No. 330 (M-442)(2053) 25 Dec. 1985, & JP-A-60 162005 (Toyota Jidosha 23 Aug. 1985, U.S. Pat. No. 4,565,164).

*Primary Examiner*—Noah P. Kamen
*Attorney, Agent, or Firm*—Evenson, Wands, Edwards, Lenahan & McKeown

[57] ABSTRACT

An oil separator for the oil contained in the crankcase gases of an internal-combustion engine is constructed in two parts consisting of an exterior housing and an insert arranged therein. The oil precipitates in the housing along two deceleration paths, is collected in oil collecting areas and is returned into the crankcase.

9 Claims, 2 Drawing Sheets

OIL SEPARATOR FOR GASES FROM A CRANKCASE OF AN INTERNAL-COMBUSTION ENGINE

BACKGROUND AND SUMMARY OF THE INVENTION

The present invention relates to an oil separator and, more particularly, to an oil separation int h form of a multipart housing on a crankcase.

German Patent Document DE 37 13 210 A1 shows a breathing arrangement with a two-part housing which as an integrated oil separator for the crankcase of an internal-combustion engine. The upper part and the lower part of the housing having projections which engage in one another similar to a toothing and thus form a labyrinth for the precipitating of oil droplets from the crankcase gases. By way of pins arranged on the upper part which penetrate openings in the lower part and the free ends of which are subsequently hot-formed, the upper and the lower part are undetachable connected with one another.

It is an object of the present invention to provide an improved oil separator for the crankcase gases of an internal-combustion engine which offers a simple and cost-effective construction and ensures an easy mounting and demounting.

This object has ben achieved in accordance with the present invention by the provision of an insert in the housing in which the exterior surface of the insert, together with the internal wall of the housing, to form a first deceleration path connecting downstream, and a second deceleration path for the gases. The deceleration paths are constructed in essentially a semicircular shape and are partly separated from one another by a transversely extending wall of the housing.

The oil separator according to the present invention is distinguished by a simple two-part construction which permits a fast mounting and dismounting with few fastening devices. An insert arranged in a boat-shaped housing bounds a space between the interior wall of the housing and the insert which is divided by a wall into two deceleration paths for the gases flowing out of the crankcase through the oil separator. The oil droplets contained in the gases precipitate along the two deceleration paths as well as on the wall and another wall arranged in front of a connection piece for the removal of the gases and flow together in two oil collecting areas. From there, they flow back into the crankcase.

The oil separator can be mounted in any area of the crankcase, without regard to the site, and, for this purpose, requires only an opening in the crankcase for the discharge of the gases and a contact surface for the mounting.

The insert requires no separate fastening devices but is form-lockingly held by way of the housing. Should the oil separator clog, it can easily be dismounted after the unfastening of screws extending through the crankcase.

BRIEF DESCRIPTION OF THE DRAWINGS

These and further objects, features and advantages of the present invention will become more apparent from the following detailed description of a presently preferred embodiment when taken in conjunction with the accompanying drawings wherein.

DETAILED DESCRIPTION OF THE DRAWINGS

Figure 1:
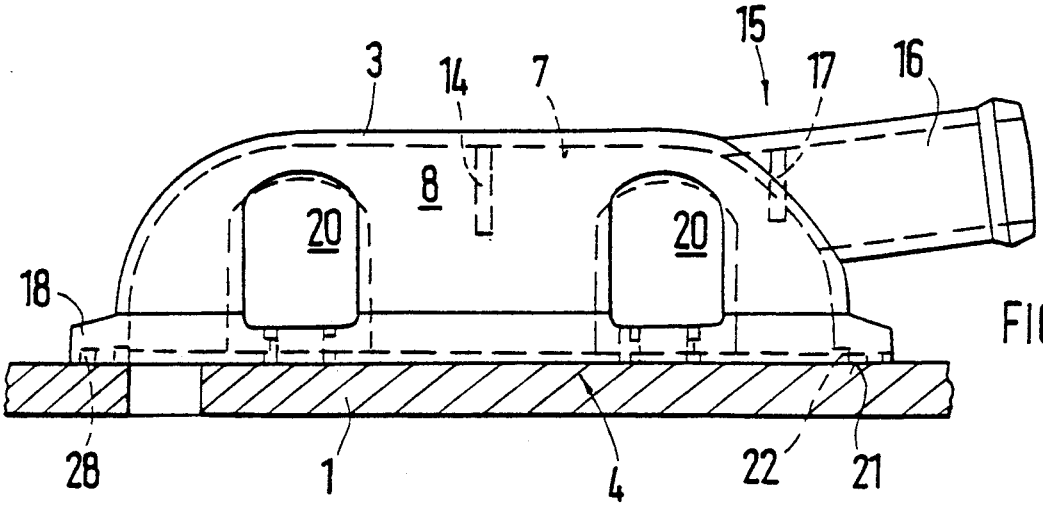
FIG. 1 is a lateral view of the oil separator housing in accordance with the present invention.
Figure 2:
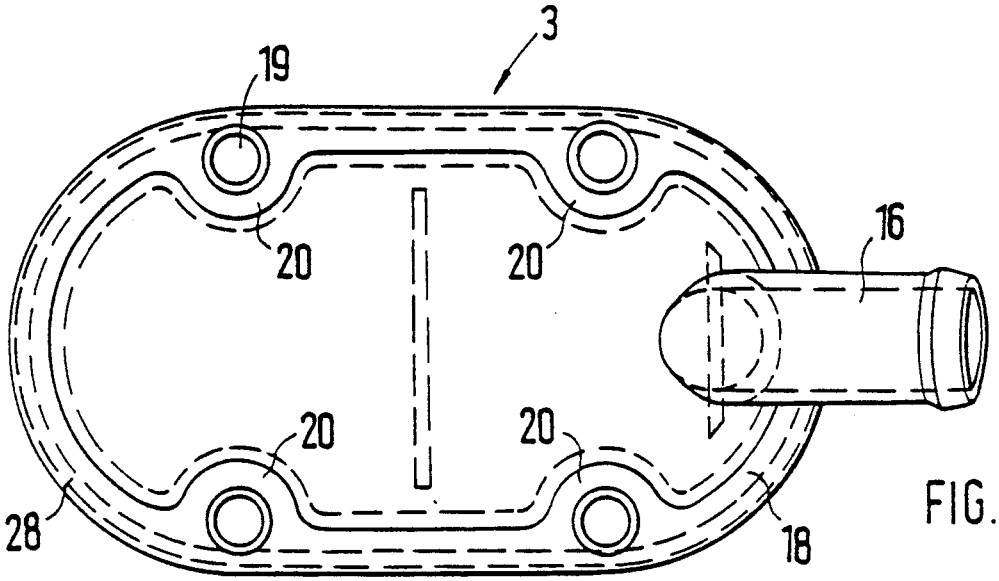
FIG. 2 is a top view of the oil separator shown in FIG. 1.
Figure 3:
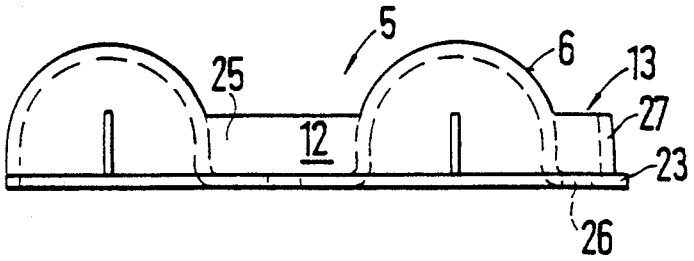
FIG. 3 is a lateral view of an insert portion of the oil separator shown in FIG. 1.
Figure 4:
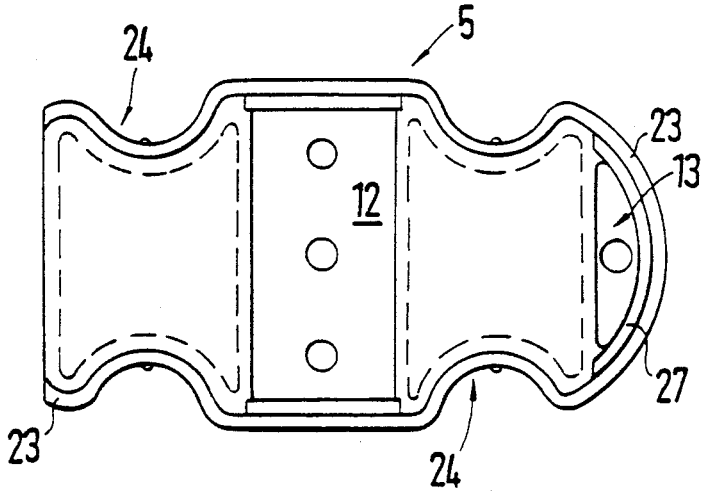
FIG. 4 is a top view of FIG. 3.
Figure 5:
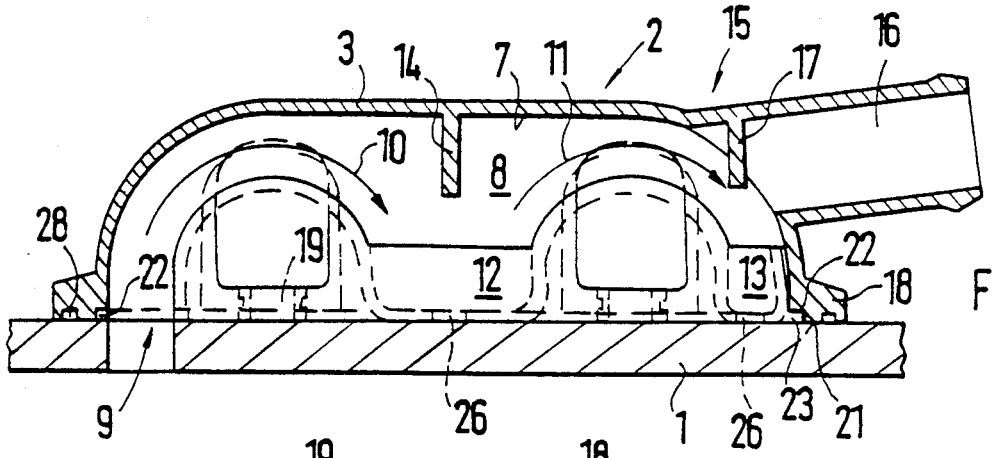
FIG. 5 is a partial sectional view of the assembled oil separator.
Figure 6:
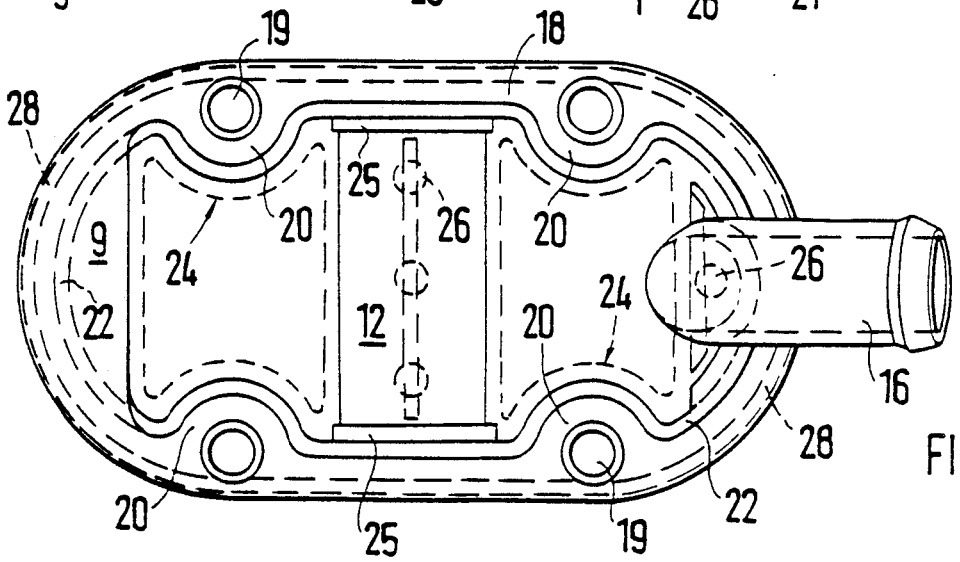
FIG. 6 is a top view of FIG. 5.

The oil separator 2 which is arranged horizontally on a crankcase 1 of an internal-combustion engine (not shown in detail), comprises a housing 3 (FIGS. 1 and 2) and an insert 5 (FIGS. 3 and 4) arranged in the opening 4. The insert 5 leaves a space 8 between its exterior surface 6 and the interior wall 7 of the housing 3. The opening 4 is closed by the insert 5 except for a remaining gap 9 (FIGS. 5 and 6). In the space 8, a first deceleration path 10 and a second deceleration path 11 connecting to it in series in the downstream direction are formed by the exterior surface 6 and the interior wall 7. The first deceleration path 10 extends from the gap 9 to a first oil collecting area 12 arranged downstream, and the second deceleration path 11 extends from the oil collecting area 12 to a second oil collecting area 13 arranged downstream. Centrally above the oil collecting area 12, a wall 14 is arranged transversely to the longitudinal course of the housing 3 and partially separates deceleration paths 10, 11 from one another.

Above the oil collecting area 13, a tube-shaped connection piece 16 for the removal of the purified gases from the crankcase is arranged on one end 15 of the housing 3. Centrally above the oil connecting area 13, the oil separator 2 has another wall 17 in the intersecting plane of the housing 3 and of the connection piece 16.

An outwardly projecting flange 18 which surrounds the opening 4 is arranged on the housing 3. Four openings 19 penetrate the flange 18 and are used for receiving screws for the fastening of the oil separator 2 on the crankcase 1. In the area of the openings 19, inwardly directed arched areas 20 are arranged in the housing 3. The underside 21 of the flange 18, in the area of the interior wall 7, has a surrounding recess 22 into which a corresponding projection 23 engages which is arranged on the insert 5. The insert 5 is form-lockingly held in the housing 4 by recesses 24 which surround the arched areas 20.

Laterally, the oil collecting area 12 is formed by boundary walls 25, and three openings 26 for the discharge of the collected oil are arranged in the bottom of the of the collected oil are arranged in the bottom of the collecting area. A boundary wall 27 adapted to the interior wall 7 at the end 15 of the insert 5 forms the oil collecting area 13 which has an opening 26. In the underside 18, a surrounding groove 28 is provided for receiving a sealing device.

During the mounting of the oil separator 2, the insert 5 is first pushed into the opening 4 of the housing 3. The inserting depth of the insert 5 into the housing 3 is limited by the recess 22 and the projection 23. A slight pressing or interference fit between the arched areas 20 and the recesses 24 prevents the insert& 5 from falling out. A sealing device, which prevents a leaking of collected oil onto the crankcase, is placed in the groove 28.

Subsequently, the oil separator 2 is fastened on the crankcase 1 by screws and openings 19. The housing 3 and the insert 5 can be manufactured of plastic in a lightweight construction and at low cost for an industrial-scale production. For increased mechanical stress, the housing 3 can be manufactured as a cast aluminum part.

During the operation of the internal-combustion engine, the oil separator 2 is acted upon by a vacuum for the scavenging of the crankcase by way of a hose fastened to the connection piece 16. This vacuum transports the gases, through a bore provided in the crankcase, through the gap 9, to the connection piece 16. The gases enriched with droplets of oil cannot reach the connection piece 16 along the shortest path from the gap 9 but ar guided through the space 8 along the deceleration paths 10, 11. The droplets which, in the process, precipitate along the exterior surface 6, the interior wall 7 and the walls 14, 17 are collected in the oil collecting areas 12, 13 by gravitation and, by way of the openings 26, are guided back into the crankcase 1. The majority of the droplets of oil precipitate on the wall 14. The remainder of mostly very fine droplets of oil precipitate on wall 17.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An oil separator for gases from a crankcase of an internal-combustion engine, comprises a multipart housing adapted to be held on the crankcase, an insert arranged in the housing, wherein the exterior surface of the insert, together with an internal wall of the housing, form a first deceleration path in series with a second deceleration path for the gases, the deceleration paths being essentially of semicircular shape and being partly separated from one another by a transversely extending wall of the housing.

2. An oil separator according to claim 1, wherein the insert has a first oil collecting area arranged downstream of the first deceleration path and a second oil collecting area arranged downstream of the second deceleration path.

3. An oil separator according to claim 2, wherein the insert, adjacent to the oil collecting areas, has recesses which surround corresponding arched areas of the housing, and an opening of the housing is tightly sealed off by said insert with the exception of a gap.

4. An oil separator according to claim 3, wherein the wall is arranged above the first oil collecting area and another wall is arranged above the second oil collecting area and partially projects into a discharge connection piece of the housing.

5. An oil separator according to claim 2, wherein two oil collecting areas including discharge openings, one area defined in part by lateral boundary walls and the second area comprising a boundary wall adjacent to the internal wall.

6. An oil separator according to claim 5, wherein the insert, adjacent to the oil collecting areas, has recesses which surround corresponding arched areas of the housing, and an opening of the housing is tightly sealed off by said insert with the exception of a gap.

7. An oil separator according to claim 6, wherein the wall is arranged above the first oil collecting area and another wall is arranged above the second oil collecting area and partially projects into a discharge connection piece of the housing.

8. An oil separator according to claim 7, wherein the housing has an open side with an outwardly projecting surrounding flange which, on its underside, has a groove surrounding a recess which is open toward the internal wall and in which a projection of the insert is arranged in the recess.

9. An oil separator according to claim 1, wherein the housing has an open side with an outwardly projecting surrounding flange which, on its underside, has a groove surrounding a recess which is opened toward the internal wall and in which a projection of the insert is arranged in the recess.

* * * * *